US006329067B2

(12) United States Patent
Uchida et al.

(10) Patent No.: US 6,329,067 B2
(45) Date of Patent: Dec. 11, 2001

(54) CHROMATING SOLUTION AND CHROMATED METAL SHEET

(75) Inventors: Yukio Uchida, Tokyo; Hirofumi Taketsu; Shinya Furukawa, both of Sakai, all of (JP)

(73) Assignee: Nisshin Steel Co., Ltd., Tokyo (JP)

( * ) Notice: Subject to any disclaimer, the term of this patent is extended or adjusted under 35 U.S.C. 154(b) by 0 days.

(21) Appl. No.: 09/752,469

(22) Filed: Jan. 3, 2001

Related U.S. Application Data

(62) Division of application No. 09/161,414, filed on Sep. 24, 1998, now Pat. No. 6,190,464.

(51) Int. Cl.[7] ..... B32B 15/04; B32B 15/01; C23C 22/26

(52) U.S. Cl. ..... 428/472.1; 106/14.12; 106/14.13; 106/14.14; 106/14.44; 148/243; 148/258; 148/264; 148/267; 428/469; 428/472; 428/472.3

(58) Field of Search ..... 106/14.05, 14.12, 106/14.44, 14.13, 14.14; 148/243, 258, 264, 267; 427/383.7; 428/457, 469, 472, 472.1, 472.3

(56) References Cited

U.S. PATENT DOCUMENTS

| | | | |
|---|---|---|---|
| 3,719,534 | 3/1973 | Vessey et al. | 148/248 |
| 4,171,231 | 10/1979 | Bishop et al. | 148/258 |
| 4,263,059 | 4/1981 | Guhde et al. | 27/383.7 |
| 4,392,922 | 7/1983 | Tomaszewski | 205/101 |
| 4,439,285 | 3/1984 | Tomaszewski | 205/101 |
| 4,460,438 | 7/1984 | Tardy et al. | 205/284 |
| 4,477,315 | 10/1984 | Tomaszewski | 205/48 |
| 4,477,318 | 10/1984 | Tomaszewski | 205/48 |
| 4,644,029 | 2/1987 | Cable et al. | 524/407 |
| 4,956,027 | 9/1990 | Saeki et al. | 148/257 |
| 4,966,634 | 10/1990 | Saeki et al. | 148/251 |
| 5,141,822 | 8/1992 | Matsuo et al. | 428/623 |
| 5,230,750 | 7/1993 | Shindou et al. | 148/258 |
| 5,366,567 | 11/1994 | Ogino et al. | 148/258 |
| 5,378,291 | 1/1995 | Ara et al. | 148/251 |
| 5,507,884 | 4/1996 | Ogino et al. | 148/258 |

FOREIGN PATENT DOCUMENTS

| | | | |
|---|---|---|---|
| 2526832 | | 1/1976 | (DE) . |
| 53-108041 | * | 9/1978 | (JP) . |
| 55-31105 | * | 3/1980 | (JP) . |
| 55-31120 | * | 3/1980 | (JP) . |
| 59-31872 | | 2/1984 | (JP) . |
| 2-66193 | * | 3/1990 | (JP) . |
| 3-219087 | | 9/1991 | (JP) . |
| 10-81976 | | 3/1998 | (JP) . |
| 10-81977 | | 3/1998 | (JP) . |
| 63-103081 | | 5/1998 | (JP) . |

* cited by examiner

*Primary Examiner*—Anthony Green
(74) *Attorney, Agent, or Firm*—Foley & Lardner

(57) ABSTRACT

In a chromating solution comprising a water-soluble chromium compound and a reducing agent and in which hexavalent chromium ions produced by dissolution of the water-soluble chromium compound have been partly reduced with the reducing agent to trivalent chromium ions, an oxycarboxylic acid compound is used as the reducing agent. This chromating solution causes neither gelation nor sedimentation of the solution even when hexavalent chromium ions are reduced to trivalent chromium ions at a reduction percentage of more than 50%. The chromating solution and a chromate film formed on a steel sheet may also contain an organic resin, phosphoric acid or a phosphoric acid compound, or a silica sol.

4 Claims, 1 Drawing Sheet

CHROMATING SOLUTION AND CHROMATED METAL SHEET

This application is a divisional of application Serial No. 09/161,414, filed Sep. 24, 1998 now U.S. Patent No. 6,190,464.

BACKGROUND OF THE INVENTION

1. Field of the invention

This invention relates to a chromating solution that can form a chromate film from which hexavalent chromium ions may little dissolve out, and a chromated metal sheet obtained using such a chromating solution.

2. Description of related art

In recent years, as chromating solutions for metal sheets such as steel sheets coated with zinc, aluminum or an alloy of these, copper-coated steel sheets and aluminum sheets, coating types are prevailing in which an aqueous solution of a water-soluble chromium compound such as a chromic acid and a chromate is coated on a metal sheet followed by drying without washing with water to form a chromate film. If chromium ions contained in such a chromating solution are all held by hexavalent chromium ions, the chromate film formed tends to be a film from which hexavalent chromium ions may dissolve out when the metal sheet is treated, and also the film may be moisture-absorptive. Accordingly, as disclosed in, e.g., Japanese Patent Applications Laid-open No. 59-31872 (a method of chromating galvanized steel sheets) and No. 3-219087 (a chromating solution for galvanized steel sheets), usually the hexavalent chromium ions are partly reduced with a reducing agent to insoluble, trivalent chromium ions so that the chromate film can be improved in corrosion resistance and moisture resistance.

As the reducing agent, organic compounds such as monohydric or polyhydric alcohols, hydrocarbons and polysaccharides and inorganic compounds such as hydrogen peroxide and hydrazine are conventionally used. When, however, these reducing agents are used to reduce hexavalent chromium ions to trivalent chromium ions at a reduction percentage of more than 50%, the trivalent chromium ions turn into chromium hydroxide because the pH increases with an increase in reduction percentage, to cause gelation and sedimentation of the chromating solution, making it difficult for the solution to be coated on metal sheets. Hence, the reduction percentage of hexavalent chromium ions has been controlled to be not more than 50%. At such a low reduction percentage, however, the hexavalent chromium ions present in the chromate film may dissolve out to produce yellow stains or to adversely affect handlers, bringing about problems.

SUMMARY OF THE INVENTION

An object of the present invention is to provide a chromating solution that may cause no gelation of the solution even when hexavalent chromium ions are reduced to trivalent chromium ions at a reduction percentage of more than 50%.

Another object of the present invention is to provide a chromated metal sheet on which a chromate film has been formed from which chromium ions may hardly dissolve out and which is not moisture-absorptive.

To achieve the above objects, as a first embodiment, the present invention provides a chromating solution comprising a water-soluble chromium compound and a reducing agent and in which hexavalent chromium ions produced by dissolution of the water-soluble chromium compound have been partly reduced with the reducing agent to trivalent chromium ions, wherein;

the reducing agent comprises an oxycarboxylic acid compound.

As a second embodiment, the chromating solution according to the first embodiment may further comprise a water-soluble or water-dispersible organic resin.

As a third embodiment, the chromating solution according to the first embodiment may further comprise phosphoric acid or a phosphoric acid compound.

As a fourth embodiment, the chromating solution according to the first embodiment may further comprise a silica sol.

The present invention also provides a chromated metal sheet comprising a metal sheet and a chromate film formed thereon by coating with a chromating solution containing a water-soluble chromium compound and a reducing agent oxycarboxylic acid compound, followed by drying without washing with water.

As another embodiment of the above chromated metal sheet, the chromating solution used may further contain i) a water-soluble or water-dispersible organic resin, ii) phosphoric acid or a phosphoric acid compound, or iii) a silica sol.

The chromating solution of the present invention may cause neither gelation nor sedimentation even when hexavalent chromium (chromium(VI)) ions are reduced to trivalent chromium (chromium(III)) ions at a reduction percentage of more than 50%, and hence enables the reduction to trivalent chromium ions at a higher percentage, so that the chromating solution can form a chromate film from which hexavalent chromium ions may little dissolve out.

DESCRIPTION OF THE PREFERRED EMBODIMENTS

Figure 1:
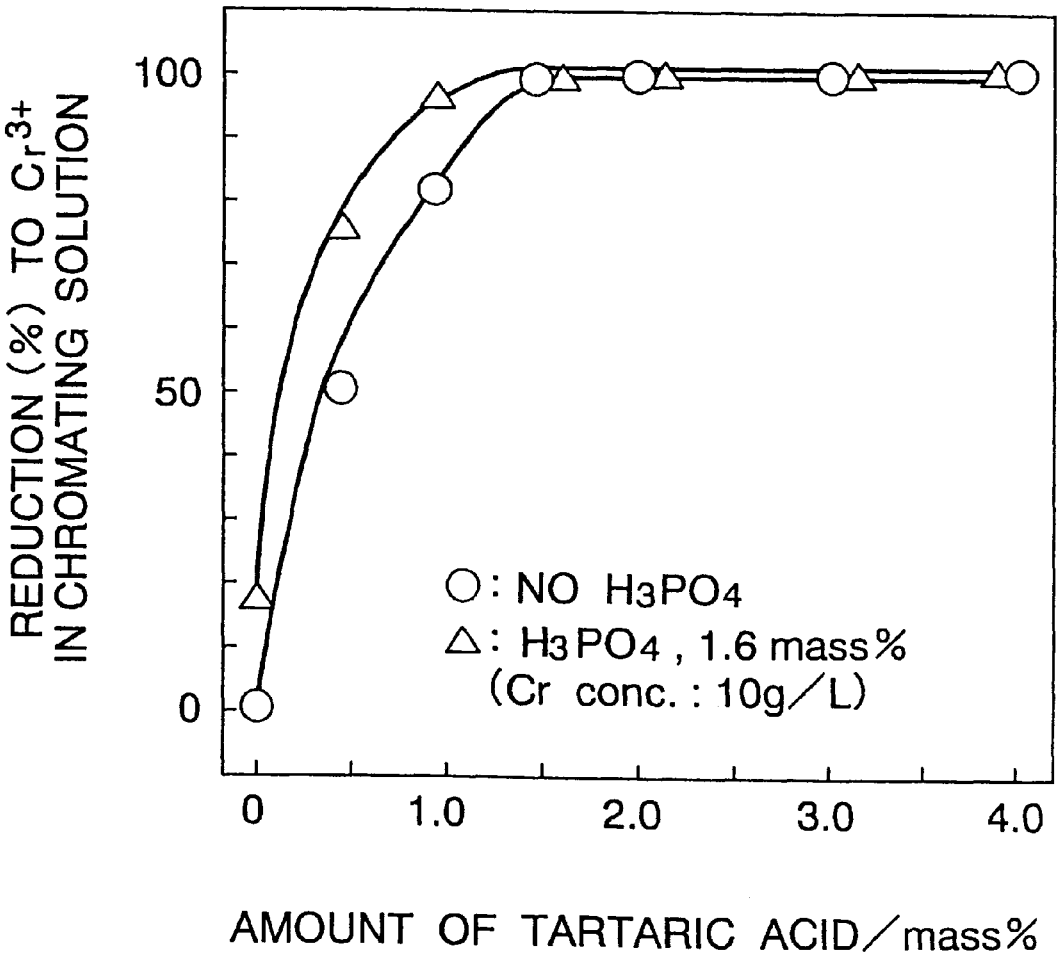
FIG. 1 is a graph showing the relationship between the reduction percentage and the amount of tartaric acid in an instance where the hexavalent chromium ions present in a chromating solution are reduced to trivalent chromium ions by addition of tartaric acid and an instance where the former is reduced to the latter by further addition of phosphoric acid.

The present inventors made various studies on reducing agents that may not cause chromating solutions to gel even when hexavalent chromium ions are reduced to trivalent chromium ions at a reduction percentage of more than 50%. As a result, they have discovered that the use of an oxycarboxylic acid compound keeps chromating solutions stable even when hexavalent chromium ions are wholly reduced to trivalent chromium ions. Here, the reason is unclear why the chromating solutions do not gel when the oxycarboxylic acid compound is used, and it is presumed that the hydroxyl group of the oxycarboxylic acid compound reduces hexavalent chromium ions to trivalent chromium ions and the carboxyl group thereof coordinates to the trivalent chromium compound to prevent gelation.

The oxycarboxylic acid compound may include tartaric acid, malonic acid, citric acid, lactic acid, glycolic acid, glyceric acid, tropic acid, benzilic acid and hydroxyvaleric acid. Any of these reducing agents may be used alone or in combination. Since their reducing power may differ depending on the compounds, the reducing agent may be added in an appropriate quantity while detecting the reduction to trivalent chromium ions.

The hexavalent chromium ions may be reduced to 0.1 or less as the ratio of $Cr^{6+}$/total chromium ions, where the hexavalent chromium ions can be substantially perfectly prevented from dissolving out from the chromate film and the film can be made hardly moisture-absorptive, even when the chromate film is formed by a method of coating the chromating solution on a metal sheet followed by drying without washing with water. Also, since the chromate film formed is colorless and transparent, it can be used for the pretreatment of coating, as in clear coating, which is not desired to have the yellow appearance ascribable to hexavalent chromium ions.

In the chromating solution, the water-soluble chromium compound may preferably be in such a concentration that the total chromium ions are in an amount of from 1 to 40 g/liter. If they are in an amount less than 1 g/liter, the chromate film formed may have an insufficient corrosion resistance, and if in an amount more than 40 g/liter, the chromating solution tends to gel.

The chromating solution may be incorporated with a water-soluble or water-dispersible organic resin such as an α,β-unsaturated carboxylic acid so that the chromate film can be improved in strength, workability and coat adhesion. Incorporation of this organic resin in an amount less than 20 g/liter may make it difficult to form a uniform resin film. Its incorporation in an amount more than 500 g/liter may make the chromating solution have so high a viscosity as to be coated with difficulty. Hence, it may be used in an amount of from 20 to 500 g/liter.

When such an organic resin is incorporated, a polymeric resin powder having a melting point of 100° C. or above is conventionally added to the chromating solution so that the chromate film can be improved in lubricity when, e.g., worked by pressing. In the present chromating solution, too, a resin powder having a melting point of 100° C. or above such as polyethylene, polypropylene or fluorine resin may be added.

In the reduction attributable to the oxycarboxylic acid compound, the reduction can be accelerated as shown in FIG. 1, with its addition in a smaller quantity when phosphoric acid or a phosphoric acid compound is added. Also, the chromate film can be formed as a sparingly soluble chromium phosphate film. As the phosphoric acid compound, water-soluble compounds such as ammonium dihydrogenphosphate may be used, which may be added in such an amount that the ratio of P/total chromium ions is from 0.1 to 4.0. If it is less than 0.1, the film may be less improved in the corrosion resistance which should be brought about by making the film sparingly soluble. If it is more than 4.0, the film may have a low water-resistant secondary gluing performance when coating is applied thereon.

In the chromating solution, a silica sol is conventionally added so that the chromate film can have higher corrosion resistance and moisture resistance. In the present chromating solution, too, the silica sol may be added. In such an instance, the silica sol may be so added as to be within the range of from 0.5 to 3.0 as the ratio of Si/total chromium ions. If it is less than 0.5, the corrosion resistance may be not so well effectively improved. If it is more than 3.0, resistance welding may be carried out with difficulty, also resulting in a low water-resistant secondary gluing performance.

The metal sheet may be treated with the present chromating solution by any known process as in the case of conventional coating type chromating. For example, the metal sheet may be coated by roll coating, air-curtain coating, electrostatic spraying, squeegee-roll coating or dipping, followed by drying without washing with water. The metal sheet having been coated with the chromating solution may be dried by force-drying if necessary.

EXAMPLES

Example 1

(1) Preparation of chromating solutions:

Chromating solutions A:

Different oxycarboxylic acid compounds were added to aqueous chromic anhydride solutions to partly reduce hexavalent chromium ions to trivalent chromium ions (Solution Nos. 1 to 6).

Chromating solutions B:

Different oxycarboxylic acid compounds were added to aqueous ammonium chromate solutions to partly reduce hexavalent chromium ions to trivalent chromium ions, followed by addition of an acrylic emulsion of a methyl methacrylate/ethyl acrylate copolymer and further followed by addition of a nonionic emulsifier and a silicone-modified polyether anti-foaming agent (Solution Nos. 7 to 11) .

(2) Chromating:

Electroplating galvanized steel sheets (sheet thickness: 0.8 mm; single Zn coating weight: 20 g/$m^2$) were coated with the chromating solutions by roll coating. In the case of the chromating solutions A, coatings were dried at an ultimate temperature of 120° C.; and in the case of the chromating solutions B, at an ultimate temperature of 150° C.

(3) Solution stability test:

Chromating solutions with a temperature of 40° C. were each set in a roll coater, which was driven for 24 hours. An instance where neither gelation nor sedimentation of resin was seen in the chromating solution was evaluated as "A"; and an instance where either was seen, as "B".

The composition of each chromating solution, solution stability and chromate film are shown in Table 1.

TABLE 1

| Composition of chromating solution | | | | | | |
|---|---|---|---|---|---|---|
| No. | Total Cr concentration (g/L) | Oxycarboxylic acid compound | $Cr^{6+}$/total Cr ratio | Resin concentration (g/L) | Solution stability | Chromate film Cr coating weight (mg/$m^2$) |
| Chromating solutions A: | | | | | | |
| 1 | 10 | Malonic acid | 0.02 | — | A | 40 |
| 2 | 12 | Citric acid | 0.10 | — | A | 42 |
| 3 | 8 | Lactic acid | 0.10 | — | A | 40 |
| 4 | 2 | Tartaric acid | 0.08 | — | A | 12 |
| 5 | 10 | Tartaric acid & lactic acid | 0.00 | — | A | 45 |
| 6 | 10 | Malonic acid | 0.30 | — | A | 40 |
| Chromating solutions B: | | | | | | |
| 7 | 10 | Malonic acid | 0.10 | 150 | A | 45 |
| 8 | 10 | Citric acid | 0.00 | 200 | A | 60 |
| 9 | 8 | Lactic acid | 0.10 | 20 | A | 40 |
| 10 | 12 | Tartaric acid | 0.02 | 500 | A | 52 |
| 11 | 10 | Tartaric acid | 0.00 | 700 | C | — |

TABLE 1-continued

| No. | Total Cr concentration (g/L) | Oxycarboxylic acid compound | $Cr^{6+}$/total Cr ratio | Resin concentration (g/L) | Solution stability | Chromate film Cr coating weight ($mg/m^2$) |
|---|---|---|---|---|---|---|
| Composition of chromating solution | | | | | | |
| Conventional solutions: | | | | | | |
| 1 | 10 | Polyvinyl alcohol | 0.10 | | C | — |
| 2 | 10 | Starch | 0.10 | | C | — |

Next, steel sheets chromated with chromating solutions having not gelled among the chromating solutions A and B were tested on the following performances. Results obtained are shown in Table 2.

(1) $Cr^{6+}$dissolving-out resistance test:

Test pieces of chromated steel sheets were immersed in 90° C. water for 3 minutes, and the quantity of $Cr^{6+}$having dissolved out was measured. An instance where they dissolved out in a quantity less than 1 $mg/m^2$ was evaluated as "A"; from 1 $mg/m^2$ to less than 5 $mg/m^2$, as "B"; and more than 5 $mg/m^2$, as "C".

(2) Color tone test:

Yellowness of steel sheets was measured on the value b* of the L*a*b* color system according to JIS Z 8730. An instance where the value b* was less than 2.0 was evaluated as "A"; and 2.0 or more, as "C". The greater the value b* is, the higher the yellowness is.

(3) Corrosion resistance test:

A 120-hour salt spray test (JIS Z 2371) was carried out. An instance where white rust appeared at a percentage less than 3% of the whole area was evaluated as "AA"; from 3% to less than 20%, as "A"; from 20% to less than 50%, as "B"; and 50% or more, as "C".

(4) Spot weldability test:

A portable spot welder was used to carry out continuous welding using a CF type electrode (4.5 mm diameter) at a pressure of 250 kgf, at an electrification time of 10 cycles and at a welding current of 8.5 kA without changing the electrode for new one, and the number of dotting until shear fracture occurred was counted. An instance where the number of dotting was 2,000 or more was evaluated as "A"; and less than 2,000, as "C".

(5) Coat adhesion test:

A solvent type acrylic coating material (SUPER LUCK F-50, available from Nippon Paint Co., Ltd.) was so coated as to have a dried-coating thickness of 30 $\mu$m, followed by immersion in 90° C. hot water for 2 hours to make a coat adhesion test according to the cross-cut test prescribed in JIS K 5400. An instance where the coat retention was 80% or more was evaluated as "A"; and less than 80%, as "C".

TABLE 2

| No. | $Cr^{6+}$ dissolving-out resistance | Color tone | Corrosion resistance | Spot weldability | Coat adhesion |
|---|---|---|---|---|---|
| Chromating solutions A: | | | | | |
| 1 | A | A | A | A | A |
| 2 | A | A | A | A | A |

TABLE 2-continued

| No. | $Cr^{6+}$ dissolving-out resistance | Color tone | Corrosion resistance | Spot weldability | Coat adhesion |
|---|---|---|---|---|---|
| 3 | A | A | A | A | A |
| 4 | A | A | A | A | A |
| 5 | A | A | A | A | A |
| 6 | B | B | A | A | A |
| Chromating solutions B: | | | | | |
| 7 | A | A | A | A | A |
| 8 | A | A | AA | A | A |
| 9 | A | A | A | A | A |
| 10 | A | A | AA | A | A |

Example 2

(1) Preparation of chromating solutions:

Chromating solutions C:

To aqueous ammonium chromate solutions having a total chromium ion concentration of 10 g/liter, tartaric acid was added to partly reduce hexavalent chromium ions to trivalent chromium ions, and phosphoric acid or silica sol was added to some of the chromating solutions having been reduced (Solution Nos. 21 to 25).

Chromating solutions D:

To aqueous disodium chromate solutions, tartaric acid was added to partly reduce hexavalent chromium ions to trivalent chromium ions, followed by addition of an acrylic emulsion of a methyl methacrylate/ethyl acrylate copolymer and further followed by addition of a nonionic emulsifier and a silicone-modified polyether anti-foaming agent. Thereafter, phosphoric acid and/or polyethylene resin powder was/were added to some of the chromating solutions (Solution Nos. 26 to 11).

(2) Chromating:

Electroplating galvanized steel sheets (sheet thickness: 0.8 mm; single Zn coating weight: 20 $g/m^2$) were coated with the chromating solutions by roll coating. In all the cases of the chromating solutions C and D, coatings were dried at an ultimate temperature of 150° C.

(3) Solution stability test:

Tested in the same manner as in Example 1.

The composition of each chromating solution, ion stability and chromate film are shown in Table 3. Results of performance tests also made in the same manner as in Example 1 are shown in Table 4.

TABLE 3

| No. | $Cr^{6+}$/total Cr ratio | Resin concentration (g/L) | Ratio of P or Si to total Cr: Phosphoric acid | Ratio of P or Si to total Cr: Silica sol | Amount of resin powder (mass %) | Solution stability | Chromate film Cr coating weight ($mg/m^2$) |
|---|---|---|---|---|---|---|---|
| Composition of chromating solution | | | | | | | |
| Chromating solutions C: | | | | | | | |
| 21 | 0.02 | — | 0.1 | — | — | A | 40 |
| 22 | 0.02 | — | 4.0 | — | — | A | 60 |
| 23 | 0.00 | — | — | 0.5 | — | A | 45 |
| 24 | 0.02 | — | — | 3.0 | — | A | 50 |
| 25 | 0.01 | — | 1.5 | 2.0 | — | A | 40 |

TABLE 3-continued

| No. | $Cr^{6+}$/total Cr ratio | Resin concentration (g/L) | Ratio of P or Si to total Cr: Phosphoric acid | Ratio of P or Si to total Cr: Silica sol | Amount of resin powder (mass %) | Solution stability | Chromate film Cr coating weight ($mg/m^2$) |
|---|---|---|---|---|---|---|---|
| | | | Chromating solutions D: | | | | |
| 26 | 0.10 | 150 | — | — | 10 | A | 50 |
| 27 | 0.00 | 200 | 1.5 | — | 2 | A | 45 |
| 28 | 0.08 | 20 | 1.5 | — | 25 | A | 45 |
| 29 | 0.01 | 180 | — | — | 35 | C | — |

TABLE 4

| No. | $Cr^{6+}$ dissolving-out resistance | Color tone | Corrosion resistance | Spot weldability | Coat adhesion |
|---|---|---|---|---|---|
| | | Chromating solutions C: | | | |
| 21 | A | A | AA | A | A |
| 22 | A | A | AA | A | A |
| 23 | A | A | AA | A | A |
| 24 | A | A | AA | A | A |
| 25 | A | A | AA | A | A |
| | | Chromating solutions D: | | | |
| 26 | A | A | A | A | A |
| 27 | A | A | AA | A | A |
| 28 | A | A | AA | A | A |
| 29 | — | — | — | — | — |

What is claimed is:

1. A chromated metal sheet comprising a metal sheet and a chromate film formed thereon by coating with a chromating solution comprising a water-soluble hexavalent chromium compound and as a reducing agent only an oxycarboxylic acid compound and in which hexavalent chromium ions produced by dissolution of the water-soluble hexavalent chromium compound have partly been reduced with an oxycarboxylic acid compound selected from the group consisting of tartaric acid, malonic acid, citric acid, lactic acid, glycolic acid, glyceric acid, tropic acid, benzilic acid and hydroxyvaleric acid, to trivalent chromium ions to 0.1 or less as a ratio of Cr 6+/total chromium ions, and the water-soluble hexavalent chromium compound is in a concentration of from 1 to 40 g/liter as the total chromium ions, followed by drying without washing with water.

2. The chromated metal sheet according to claim 1, wherein said chromating solution further comprises an α,β-unsaturated carboxylic acid polymer added in an amount of from 20 g/liter to 500 g/liter.

3. The chromated metal sheet according to claim 1, wherein said chromating solution further comprises phosphoric acid or a phosphoric acid compound, added in a ratio of P/total chromium ions of from 0.1 to 4.0.

4. The chromated metal sheet according to claim 1, wherein said chromating solution further comprises a silica sol added in a ratio of Si/total chromium ions of from 0.5 to 3.0.

* * * * *